US006864440B2

(12) United States Patent
Kim

(10) Patent No.: US 6,864,440 B2
(45) Date of Patent: Mar. 8, 2005

(54) MODE SWITCH OF VIDEO CASSETTE RECORDER

(75) Inventor: Ji-Bum Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/620,590

(22) Filed: Jul. 17, 2003

(65) Prior Publication Data

US 2004/0141715 A1 Jul. 22, 2004

(30) Foreign Application Priority Data

Jan. 22, 2003 (KR) ..... 10-2003-0004374

(51) Int. Cl.[7] ..... H01H 19/58
(52) U.S. Cl. ..... 200/11 R; 200/11 D; 200/11 A
(58) Field of Search ..... 200/11 R, 11 A, 200/11 D, 11 DA, 11 G, 564, 570, 571, 336, 292

(56) References Cited

U.S. PATENT DOCUMENTS 4,922,063 A * 5/1990 Shimizu et al. ..... 200/11 R
5,408,275 A * 4/1995 Song et al. ..... 348/734
5,546,067 A * 8/1996 Schmidt et al. ..... 200/11 DA

* cited by examiner

*Primary Examiner*—Lincoln Donovan
*Assistant Examiner*—M. Fishman
(74) *Attorney, Agent, or Firm*—Fleshner & Kim, LLP

(57) ABSTRACT

An improved switch for an electronic device is provided which includes a main printed circuit board having a contact point mode pattern at an upper surface thereof, and a rotor rotatably installed on the main printed circuit board. One or more brushes are provided with either the rotor or the main printed circuit board so as to be connected to the contact point mode pattern. The rotor may be engaged to a moving member of the electronic device so that the rotor is rotated to different orientations depending on the operational mode of the electronic device. Because the rotor is directly installed on the main printed circuit board, the number of construction components is reduced, and the product can be more compact.

17 Claims, 4 Drawing Sheets

MODE SWITCH OF VIDEO CASSETTE RECORDER

BACKGROUND OF THE INVENTION

1. Field of the Invention

The present invention relates to a mode switch of a video cassette recorder mechanism, and more particularly, to a mode switch of a video cassette recorder (VCR) which detects operation locations of a loading device. The mode switch converts the operation locations into electric signals, then transmits the signals to a system control unit of the VCR.

2. Background of the Related Art

Generally, a video cassette recorder (VCR) includes a tape deck mechanism having a tape loading device, a cassette tape loading device, a tape driving device, a brake operating device, a brake device, a driving force shielding device, and a system control unit for controlling an operation of the tape deck mechanism.

In response to a user pushing operational mode keys such as play, stop, fast forward, and rewind, the system control unit controls each component of the tape deck mechanism. Also, a mode switch converts the mode of the tape deck mechanism into an electric signal and outputs the signal to the system control unit, thereby controlling operations of the deck mechanism by the system control unit. Typically, a cam gear rotated by a driving motor is installed on the tape deck mechanism of the VCR, and the mode switch is engaged to the cam gear. The mode switch outputs the signal based on a detected rotation angle of the cam gear. By the control signal output from the mode switch, modes such as play, reverse play, fast forwarding, rewinding, cue, and review are performed.

FIG. 1 is a disassembled perspective view showing a conventional mode switch, and FIG. 2 is a longitudinal section view of FIG. 1.

As shown, in the conventional mode switch 10, a rotor 12 is ratably engaged to a stator 11, and the stator 11 is fixed to a main printed circuit board 20.

An engaging hole 21, a welding hole 22, and terminal engaging holes 23 are formed at the main printed circuit board 20 of a single surface type having circuit devices only at a lower portion thereof.

A fixing hook 11*a* is formed at one side of the stator 11 so as to be inserted to the engaging hole 21. A welding hole 22 of the main printed circuit board 20, receives a protrusion 11*b* formed at a bottom surface of the stator 11. Terminals 11*e* are formed at the other side of the stator 11.

Before assembling the stator 11 to the main printed circuit board 20, the rotor 12 is assembled to the stator 11. To this end, an engaging hole 11*d* is formed at a center portion of the stator 11 on which a contact point mode pattern 11*c* is formed, and engaging hooks 12*a* is formed at a center portion of a lower surface of the rotor 12.

A protrusion 12*c* engaged to the cam gear is formed at an upper surface of the rotor 12, and one or more brushes 12*b* are mounted in the rotor 12 so as to be connected to the contact point mode pattern 11*c* of the stator 11.

Accordingly, first of all, the engaging hooks 12*a* of the rotor 12 are fitted to the engaging hole 11*d* to fix the rotor 12 to the stator 11. Then the fixing hook 11*a* of the stator 11 is fitted to the engaging hole 21 of the main printed circuit board 20. The protrusions 11*b* of the stator 11 are fitted to the welding holes 22, and the terminals 11*e* are fitted to the terminal engaging holes 23. Subsequently, the stator 11 is fixed to the main printed circuit board 20 by soldering the terminals 11*e* of the stator 11.

In this conventional rotation mode switch, the stator 11 is fixed to the main printed circuit board 20 by soldering between the fixing hook 11 a and the terminals 11*e*. If the cam gear is rotated by a driving force of a cam driving motor not shown in drawings, the rotor 12 engaged to the cam gear is rotated.

At this time, if the brushes 12*b* of the rotor 12 are contacted to the contact point mode pattern 11*c* of the stator 11 at a predetermined position, a control unit (not shown) detects a corresponding mode by a combination between the brushes 12*b* and the contact point mode pattern 11*c*. The detected signal is fed back to the cam driving motor to operate an operating device into a specific mode.

However, in the conventional mode switch of a VCR, since the rotor is engaged to the stator and the stator is fixed to the main printed circuit board, an entire thickness of the VCR becomes large.

As opposed to the conventional trend that a VCR using a tape cassette and a DVD using an optical disc are separately purchased, current consumers prefer to purchase a product which includes both the VCR and the DVD. In case of the unified type device, since mechanisms of the VCR and the DVD have to be installed in the same device, an entire structure becomes complicated.

Accordingly, in case of the unified type product, a cassette tape is thicker than an optical disc, and a carrier for mounting the cassette tape to the deck mechanism has to be large. Therefore, the VCR becomes thick, which causes an entire thickness of the unified type to be large.

SUMMARY OF THE INVENTION

An object of the invention is to solve at least the above problems and/or disadvantages and to provide at least the advantages described hereinafter.

Therefore, an object of the present invention is to provide a mode switch of a VCR which can greatly slim a unified type product which includes both a VCR and a DVD by simplifying a structure of the mode switch.

To achieve these and other advantages and in accordance with the purpose of the present invention, as embodied and broadly described herein, there is provided a mode switch of a VCR comprising: a main printed circuit board having a contact point mode pattern at an upper surface thereof; and a rotor rotative installed on the main printed circuit board with brushes mounted therein so as to be connected to the contact point mode pattern. The rotor is engaged to a cam gear of the VCR.

An engaging hole is formed on the main printed circuit board so that the rotor can be rotative installed on the main printed circuit board, and one or more engaging hooks are fitted to the engaging hole at the center of the rotor.

The main printed circuit board may include devices and electrical patterns on both surfaces.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings, in which like reference numerals refer to like elements, and wherein.

DETAILED DESCRIPTION OF PREFERRED EMBODIMENTS

Figure 1:
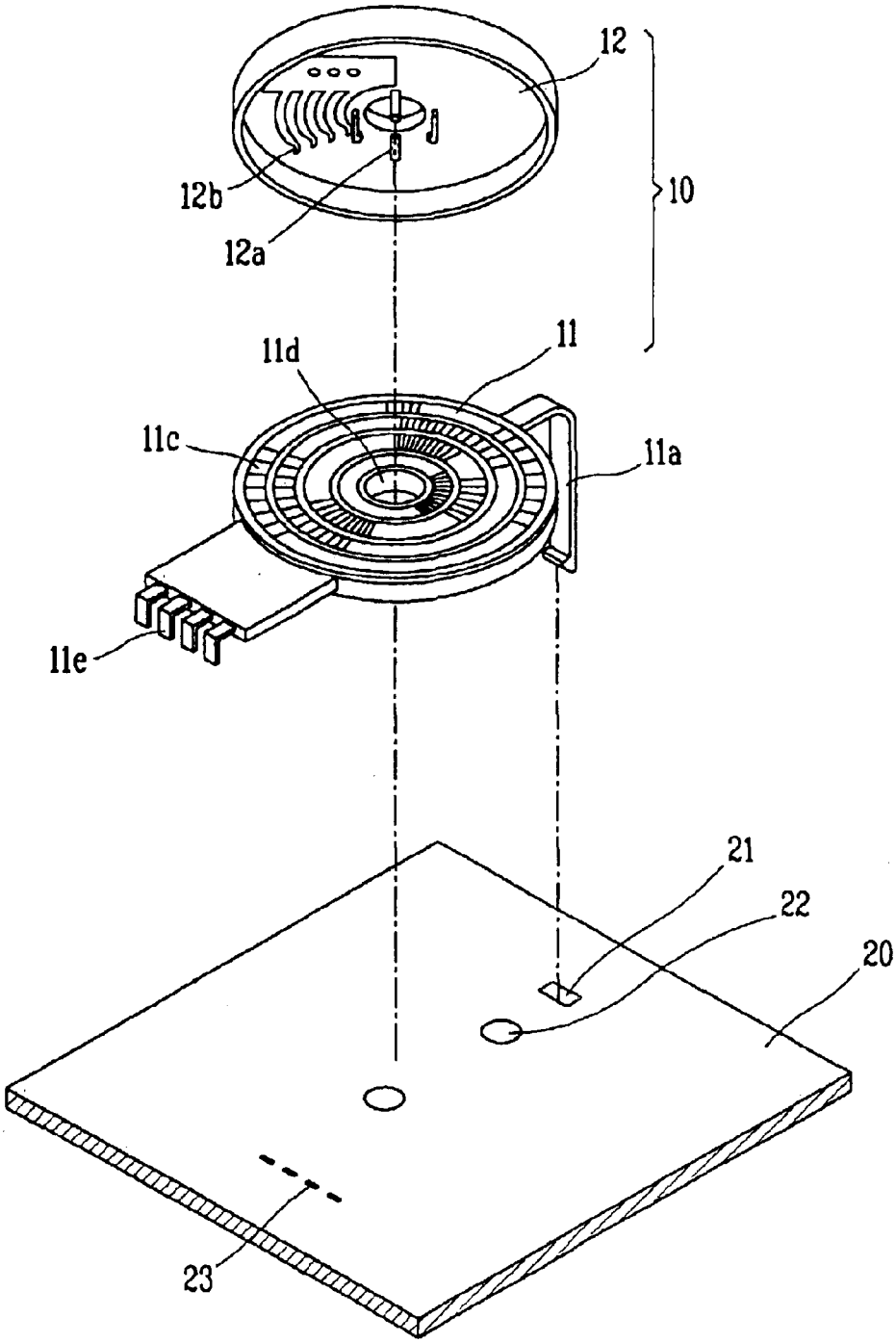
FIG. 1 CONVENTIONAL ART
FIG. 1 is a disassembled perspective view showing a mode switch in accordance with a conventional art.
Figure 2:
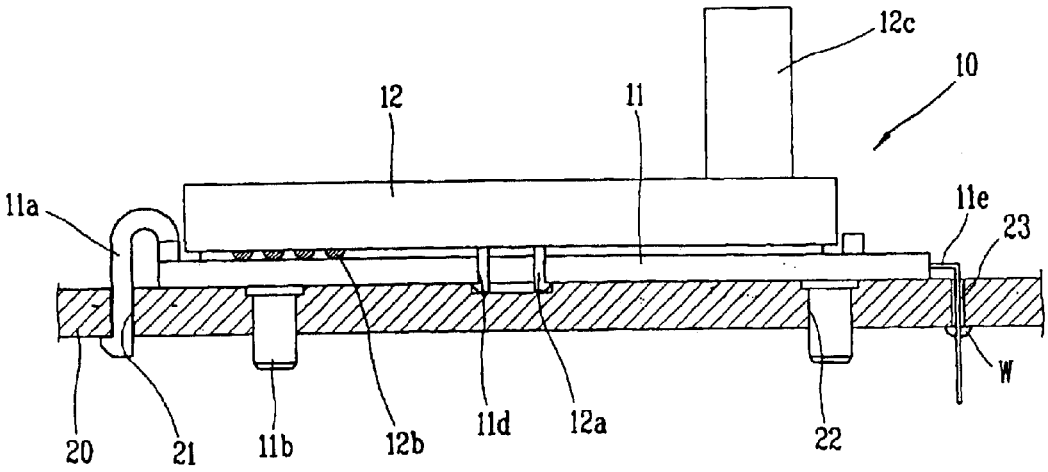
FIG. 2 CONVENTIONAL ART
FIG. 2 is a longitudinal section view of FIG. 1.
Figure 3:
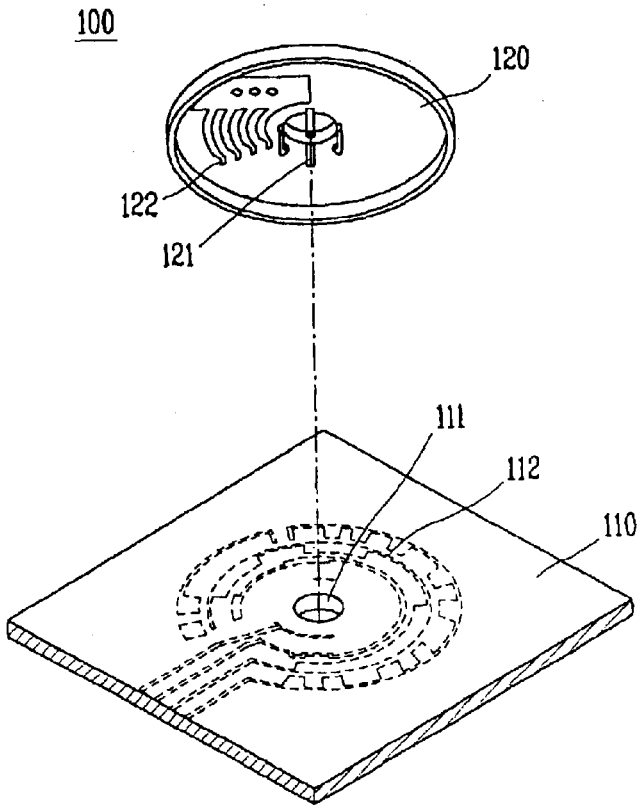
FIG. 3 is a disassembled perspective view showing a mode switch in accordance with the present invention.
Figure 4:
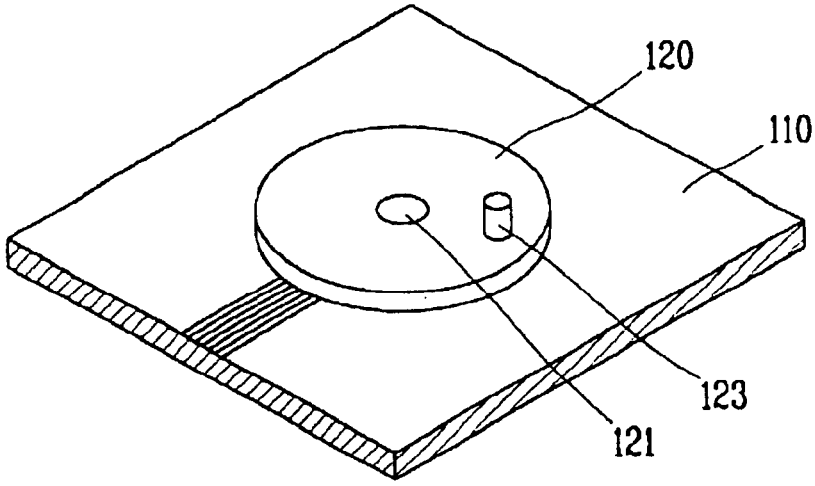
FIG. 4 is an assembled perspective view showing a mode switch in accordance with the present invention.
Figure 5A:
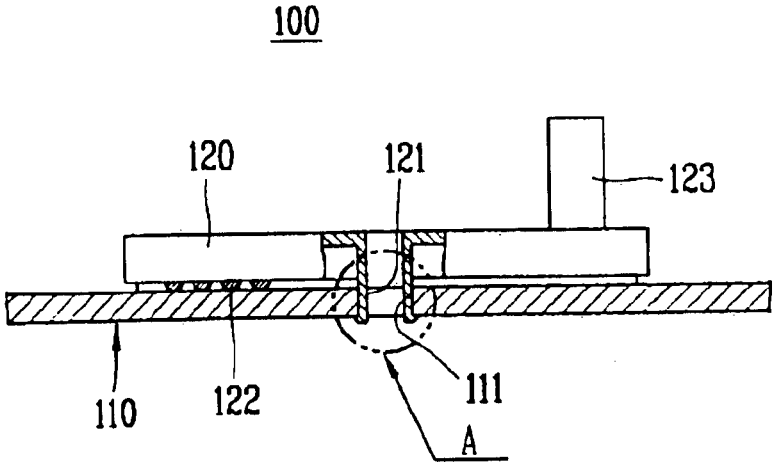
FIG. 5A is a longitudinal section view of the mode switch of FIG. 4.
Figure 5B:
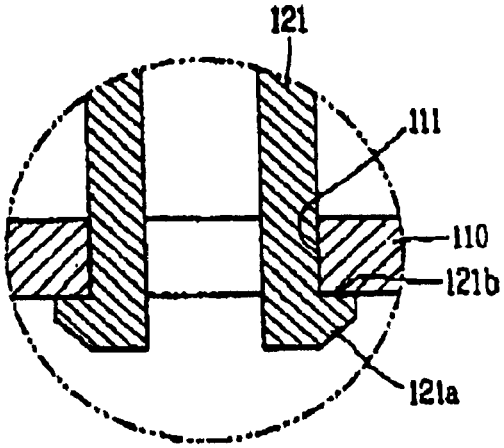
FIG. 5B is an enlarged view of the central portion of the mode switch shown in 5A.

Reference will now be made in detail to preferred embodiments of the present invention, examples of which are illustrated in the accompanying drawings.

As shown, a mode switch 100 of the present invention comprises: a main printed circuit board 110 having a contact point mode pattern 112 at an upper surface thereof; and a rotor 120 rotative installed on the main printed circuit board 110. Brushes 121 are mounted therein so as to be connected to the contact point mode pattern 112. A protrusion 123 on the rotor 112 is engaged to a cam gear of the VCR (not shown).

In case of a unified type product which includes both a VCR and a DVD player, slimming the product is very important to obtain competitiveness. As a result, any technique to make the mode switch slimmer is very desirable. To this end, in the mode switch 100 of the present invention, the rotor 120 is directly installed on the main printed circuit board 110 without the need for a separate stator.

An engaging hole 111 is formed on the main printed circuit board 110 so that the rotor 120 can be rotative installed on the main printed circuit board 110. One or more engaging hooks 121 are formed at a center portion of the rotor 120 and the engaging hooks are configured to engage the engaging hole 111 of the printed circuit board 110.

The main printed circuit board 110 used in the present invention is configured such that circuit devices can be mounted on a lower surface thereof, and the contact point mode pattern 112 is formed at an upper surface thereof.

That is, the circuit devices for driving each construction component are located on the lower surface of the main printed circuit board 110. At the upper surface of the main printed circuit board 110, the contact point mode pattern 112 of copper foil is exposed to outside so as to be contacted to one or more brushes 122 on the rotor. Although copper foil is preferred for the contact point mode pattern 112, any electrically conductive material could be used. The position of the brushes on the contact point mode pattern indicate an operating mode of the VCR.

A tape deck (not shown) is generally located on an upper portion of the main printed circuit board 110. A cam gear is mounted on a lower surface of the tape deck so as to be rotated by the driving motor.

The rotor 120 is installed on the main printed circuit board 110 by the engaging hooks 121. An engaging protrusion 123 engaged to the cam gear is formed at an upper surface thereof, so that the engaging protrusion 123 is engaged to the cam gear when the tape deck mechanism is located above the main printed circuit board 110.

Brushes 122 are fixed in the rotor 120, and the brushes 122 are selectively connected to the contact point mode pattern 112 of the main printed circuit board 110. Accordingly, the rotor 120 engaged to the cam gear is rotated around the engaging hooks 121 as the cam gear is rotated, and at this time, a control unit (not shown) can detect a specific mode of the VCR based on a position of the brushes on the contact point mode pattern 112.

The engaging hooks 121 of the rotor 120 have an elastic force, and an inclined plane 121*a* is formed at an end part of the engaging hooks 121 to allow the engaging hooks 121 to be smoothly engaged to the engaging hole 111. A stopping portion 121*b* is formed just above the inclined plane 121*a*. The engaging hooks 121 can be formed integrally with the rotor 120, and the rotor 120 can be inserted to the main printed circuit board 110 by forming an additional member.

Processes for assembling the rotor 120 to the main printed circuit board 110 in the mode switch 100 of the VCR of the present invention will be explained as follows.

First, the engaging hooks 121 of the rotor 120 are fitted to the engaging hole 111 of the main printed circuit board 110 and slightly pressed, so that the inclined plane 121*a* formed at the end part of the engaging hooks 121 is pressed against an inner circumferential surface of the engaging hole 111, and such that the engaging hooks 121 are elastically deformed. If the rotor 120 is pressed downwardly, the engaging hooks 121 elastically come back to an initial position. At this time, the stopping portion 121*b* of the engaging hooks 121 abut the lower surface of the main printed circuit board 110, thereby engaging the rotor 120 to the main printed circuit board 110. The rotor 120 can be rotated by being connected to the cam gear. Also, a predetermined interval has to be maintained between the rotor 120 and the main printed circuit board 110.

If the engaging hooks 121 are engaged to the engaging hole 111, the brushes 122 of the rotor 120 are connected to the contact point mode pattern 112 of the main printed circuit board 110. The rotor 120 is rotative engaged on the main printed circuit board 110 and at the same time, is engaged with the cam gear.

Hereinafter, operations for detecting a mode in the mode switch of the present invention will be explained.

If the cam gear is rotated by the driving force of the cam gear driving motor, the rotor 120 engaged to the cam gear is rotated. At this time, if the brushes 122 of the rotor 120 are contacted to the contact point mode pattern 112 of the main printed circuit board 110, the control unit detects a corresponding mode by a combination between the brushes 122 and the contact point mode pattern 112. Then, the detected signal is fed back to the cam gear driving motor to operate the operating device into a specific mode.

Figure 6:
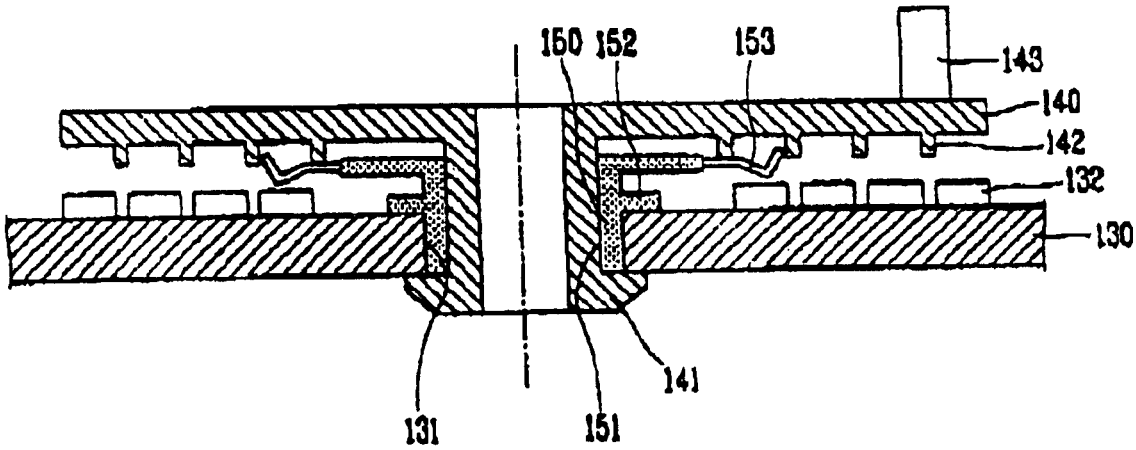
FIG. 6 is a sectional view of a mode switch according to another embodiment of the invention.

FIG. 6 is a sectional view of another mode switch embodying the invention. In this embodiment, a hole 131 is formed in a printed circuit board 130. A plurality of contact point mode patterns 132 are formed on an upper surface of the printed circuit board 130. The contact point mode patterns 132 are arranged in a ring around the hole 131.

A generally cylindrical contactor 150, is arranged within the hole 131. The contactor 150 includes a hole 151 passing therethrough. A flange 152 is configured to abut with the upper surface of the circuit board. The flange ensures that the contactor is maintained at the proper distance about the top surface of the circuit board.

The contactor 150 also includes one or more brushes 153, which project from sides of the contactor 150. All of the brushes 153 are electrically conductive, and they are all electrically coupled to each other.

A rotor 140 is mounted on the circuit board 130. An engaging hook 141 passes through the holes in the contactor and the printed circuit board so that the rotor 140 is mounted on the circuit board. The rotor also includes a plurality of contact protrusions 142 are formed on a lower surface of the rotor 140. The height of the protrusions 142 is sufficient to push the brushes 153 into contact with the contact point mode patterns 132 formed on the upper surface of the circuit board.

An engaging protrusion 143 is formed on an upper surface of the rotor 140. A cam gear of a VCR mechanism engages the engaging protrusion 143 to rotate the rotor 140. The rotation of the rotor causes certain contact protrusions 142 to press brushes 153 into contact with the contact point mode patterns 132. The pattern of electrically coupled contact point mode patterns 132 is then sensed to determine the specific operation mode of the device.

As aforementioned, in the mode switch of the present invention, no separate stator is required. Instead, the rotor is installed directly on the main printed circuit board, thereby reducing the number of components and slimming the product.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A mode switch for a video cassette recorder (VCR), comprising:

a main printed circuit board comprising a contact point mode pattern exposed on an upper surface thereof;

a plurality of brushes mounted on the main printed circuit board and positioned over the contact point mode pattern, wherein the plurality of brushes are configured to be deflected so as to contact the contact point mode pattern; and a rotor rotatably installed on the main printed circuit board, the rotor comprising a plurality of protrusions configured to deflect the plurality of brushes.

2. The mode switch of claim 1, wherein the rotor is configured to rotate in response to a driving force such that the rotor is rotated to different orientations based on an operating mode of the VCR.

3. The mode switch of claim 1, wherein the plurality of brushes are all electrically coupled to one another.

4. The mode switch of claim 1, wherein the main printed circuit board further comprises an engaging hole formed therein, and wherein the rotor further comprises at least one engaging hook configured to engage the engaging hole so as to rotatably install the rotor on the main printed circuit board.

5. The mode switch of claim 1, wherein the contact point mode pattern comprises a plurality of concentric rings of conductive patterns formed on the upper surface of the main printed circuit board.

6. The mode switch of claim 5, wherein the each of the plurality of brushes corresponds to a different concentric ring of the plurality of concentric rings of conductive patterns.

7. The mode switch of claim 1, wherein the plurality of protrusions are configured to selectively deflect the plurality of brushes based on a rotational orientation of the rotor.

8. The mode switch of claim 1, wherein the main printed circuit board further comprises an engaging hole and a contactor portion provided in the engaging hole, wherein each of the plurality of brushes extends outward from the contactor portion of the main printed circuit board and over the contact point mode pattern.

9. The mode switch of claim 8, wherein the rotor further comprises at least one engaging hook configured to engage the engaging hole, and wherein the contactor portion of the main printed circuit board is disposed between the engaging hole and the engaging hook when the rotor and the main printed circuit board are engaged.

10. A mode switch for a video cassette recorder (VCR), comprising:

a main printed circuit board comprising an engaging hole and a contact point mode pattern exposed on an upper surface thereof;

a contactor positioned within the engaging hole of the main printed circuit board, said contactor comprising a plurality of brushes mounted on the main printed circuit board and a flange configured to abut an upper surface of the main printed circuit board, wherein the plurality of brushes are positioned over the contact point mode pattern, and wherein the brushes are configured to be deflected so as to contact the contact point mode pattern; and a rotor rotatably mounted on the main printed circuit board and comprising a plurality of protrusions configured to deflect the plurality of brushes, wherein the plurality of protrusions are patterned such that different combinations of the plurality of brushes are deflected based on a rotational orientation of the rotor.

11. The mode switch of claim 10, wherein the contactor further comprises a through hole, and wherein the rotor comprises at least one engaging hook configured to engage the through hole so as to rotatably mount the rotor on the main printed circuit board.

12. The mode switch claim 10, wherein the plurality of brushes project from side portions of the contactor.

13. A mode switch for a video cassette recorder (VCR), comprising:

a main printed circuit board comprising an engaging hole formed therethrough and a contact point mode pattern exposed on an upper surface thereof;

a contactor positioned within the engaging hole of the main printed circuit board, said contactor comprising a plurality of brushes mounted on the main printed circuit board and positioned over the contact point mode pattern, wherein the plurality of brushes are configured to be deflected so as to contact the contact point mode pattern; and a rotor comprising at least one engaging hook configured to engage a corresponding engaging hole formed in the main printed circuit board so as to rotatably mount the rotor on the contactor, and a plurality of protrusions configured to deflect the brushes when the rotor and the contactor are engaged.

14. The mode switch of claim 13, wherein the contactor further comprises a flange configured to abut an upper surface of the main printed circuit board.

15. The mode switch claim 13, wherein the plurality of brushes are configured to project from side portions of the contactor.

16. The mode switch of claim 13, wherein the plurality of protrusions are configured to selectively deflect the plurality of brushes based on a rotational orientation of the rotor.

17. The mode switch of claim 13, wherein the plurality of brushes are electrically coupled to one another.

* * * * *